US005579828A

United States Patent [19]

Reed et al.

[11] Patent Number: 5,579,828

[45] Date of Patent: Dec. 3, 1996

[54] FLEXIBLE INSERT FOR HEAT PIPE FREEZE PROTECTION

[75] Inventors: Stuart E. Reed, Homeworth; Robert W. Tillman, Alliance; Harold W. Wahle, North Canton, all of Ohio

[73] Assignee: Hudson Products Corporation, Houston, Tex.

[21] Appl. No.: 586,104

[22] Filed: Jan. 16, 1996

[51] Int. Cl.[6] ..... F28D 7/00

[52] U.S. Cl. ..... 165/83; 165/82; 165/104.21; 165/104.13; 165/134.1; 62/530

[58] Field of Search ..... 165/134.1, 104.26, 165/104.21, 104.13, 82, 83; 62/530, 529

[56] References Cited

U.S. PATENT DOCUMENTS

| | | | |
|---|---|---|---|
| 1,380,987 | 6/1921 | Lippincott | 62/530 |
| 3,777,811 | 12/1973 | Shcosinger | 165/104.13 |
| 4,248,295 | 2/1981 | Ernst et al. | 165/104.26 |
| 4,355,522 | 10/1982 | Gorski et al. | 165/104.21 X |
| 4,664,181 | 5/1987 | Sumberg | 165/134.1 X |
| 5,143,053 | 9/1992 | Baer | 165/83 X |

FOREIGN PATENT DOCUMENTS

| | | | |
|---|---|---|---|
| 0112643 | 7/1982 | Japan | 165/104.13 |

*Primary Examiner*—John Rivell
*Assistant Examiner*—Christopher Atkinson
*Attorney, Agent, or Firm*—Michael L. Hoelter; Robert J. Edwards

[57] ABSTRACT

A flexible, pressurized insert for insertion within the hot (evaporator) side of an inclined heat pipe that forms a part of a heat pipe heat exchanger. This insert is employed in order to prevent such heat pipe from rupturing in the event the working fluid contained therein freezes. This insert is constructed of a thin-walled flexible material that is capable of being deformed (i.e. compressed) thereby absorbing the expansion pressures exerted by the working fluid should the working fluid freeze or be exposed to freezing temperatures. By such absorption, the outer heat pipe itself will not be over-pressurized which might otherwise lead to its rupture. Upon the thawing of the working fluid, the pressurized insert (which is at a pressure greater than that of the working fluid in its non-frozen state) will once again regain its shape.

21 Claims, 1 Drawing Sheet

FLEXIBLE INSERT FOR HEAT PIPE FREEZE PROTECTION

FIELD OF THE INVENTION

This invention pertains to heat pipe heat exchangers in general and more particularly to a manner of preventing the heat pipe from rupturing in the event the working fluid therein freezes.

DESCRIPTION OF THE PRIOR ART

Heat pipe heat exchangers are well known and are commonly used to heat and cool both gases and liquids. They operate by passing hot fluid through an array of heat pipes which contain a working fluid therein. This working fluid acts as the heat transport medium which absorbs the heat from the hot side of the heat exchanger and transports such heat to the cold side where it is cooled. Upon such cooling, the working fluid again becomes available for heat absorption from the hot side of the heat exchanger. This cycle then repeats itself.

One major problem associated with heat pipe heat exchangers is the freezing of the working fluid when the heat exchanger is not in operation. Such freezing causes this working fluid (generally water) to expand thereby potentially rupturing the heat pipe causing a catastrophic failure of the heat exchanger, or at least a portion thereof.

In the past, three general methods have surfaced to address this problem. First, the wall thickness of the heat pipe was increased so as to withstand the forces imposed by the freezing water. However, as can be imagined, this greatly increases the cost of the heat exchanger.

Second, chemical additives were added to the working fluid to lower the freezing temperature of the working fluid below the lowest expected operating temperature. Unfortunately, such chemical additives are often hazardous and they may not be able to suppress the freezing point sufficiently for some applications in which the exposure or ambient temperature is considerably below the adjusted freezing point. Also, over time, such chemicals have a tendency to break down thereby reducing their ability to lower the freezing point as needed (such chemical breakdown being unknown to the operator until such time that a heat pipe ruptures). Furthermore, the use of chemicals in the working fluid results in a coating on the inside wall of the heat pipe thereby blanketing the heat pipe and reducing its effectiveness. Chemical additives may also cause corrosion on the heat pipe wall surfaces and they may adversely react with the working fluid or the gases contained therein.

The third method employs a controlled heat source, such as an electric heater, to maintain the working fluid in the heat pipe above freezing temperatures. Such external heaters significantly increase the cost of the heat exchanger since they add complexity and must be protected from the elements while still being able to supply heat to the exposed heat pipe. Also, such heaters do not provide protection during transportation when power is not available or during instances of power failure (which usually occur as a result of the sudden onslaught of cold and icy temperatures).

It is thus an object of this invention to provide another manner of preventing damage to the heat pipe as a result of the freezing of the working fluid in heat pipe heat exchangers. Another object of this invention is to provide such freeze protection without the need for power or external connections so that freeze protection is always available even during transportation and construction of the heat exchanger, during power outages, and when the heat exchanger is taken out of operation such as when being repaired or maintained. A further object of this invention is to provide freeze protection that will not interfere with the heat exchange operation occurring in the heat pipe. Yet another object of this invention is to provide freeze protection that will not break down nor undergo a reduction in its ability to protect over time. Still another object of this invention is to provide such freeze protection at low cost and with only marginally increased manufacturing and material costs. These and other objects and advantages of this invention will become obvious upon further investigation.

SUMMARY OF THE INVENTION

This invention pertains to a manner of protecting inclined heat pipes, such as those normally found within a heat pipe heat exchanger, from rupturing in the event the working fluid contained therein freezes. It consists of generally centrally locating an insert within the hot side of the heat pipe where the working fluid normally collects. This insert is immersed within this working fluid and extends up to or slightly beyond the at-rest level of the working fluid in the heat pipe. A gas/liquid mixture is contained within the insert with this mixture being at a pressure greater than the pressure of the non-frozen working fluid (i.e. the pressure normally found in the heat pipe). This insert is generally constructed of a thin-walled material or foil pillow that can flex and be deformed without failing. Consequently, as the working fluid expands while it freezes, the insert contained therein is compressed by the greater forces exerted by the frozen working fluid. Such compression of the insert thus avoids any over-pressurization or failure of the heat pipe due to the expansion of the working fluid. This compression of the insert is accomplished by the further pressurization of the gas/liquid mixture contained therein. Upon the thawing of the working fluid, the pressurized insert flexes back to its normal shape due to the now greater pressure in the insert over that of the non-frozen working fluid.

DETAILED DESCRIPTION OF THE PREFERRED EMBODIMENTS

Figure 1:
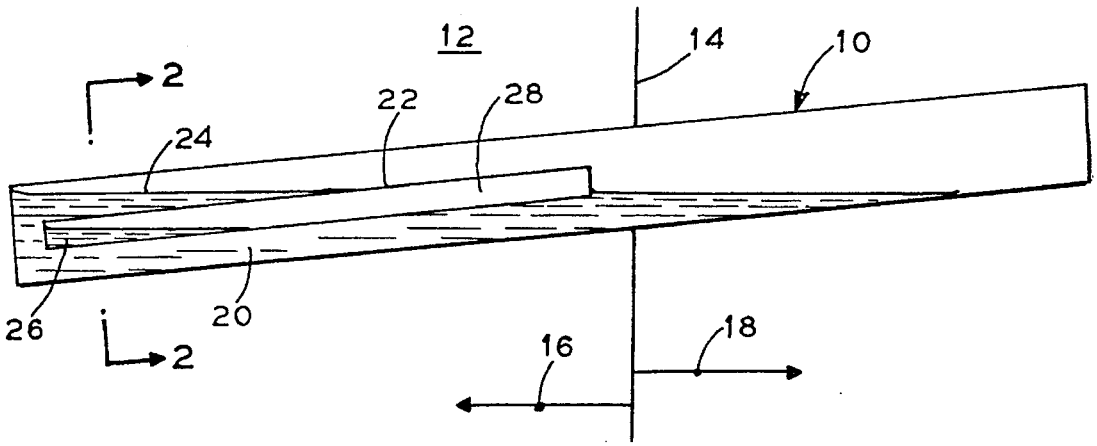
FIG. 1 is a pictorial view of a typical heat pipe of a heat pipe heat exchanger with the invention shown therein.

Referring initially to FIG. 1, there is shown a pictorial view of a heat pipe 10 normally found within a heat pipe heat exchanger 12. Such heat exchanger 12 normally incorporates a divider plate 14 which separates hot or heat absorption side 16 from cold or heat rejection side 18. As indicated, heat pipe 10 extends across such sides 16 and 18 at a slight incline, this incline rising from hot side 16 toward cold side 18. The purpose of this incline of heat pipe 10 is so that working fluid 20 (usually water, but it can also be methanol, ammonia or the like) will naturally gravitate or collect in hot side 16 of heat exchanger 12. Consequently, should heat exchanger 12 not be operating (such as when being repaired, maintained or constructed), the collected working fluid 20 in hot side 16 is subject to freezing should such fluid 20 be exposed to freezing temperatures.

To prevent heat pipe damage from such freezing, a flexible insert 22 is placed in hot side 16 of heat pipe 10. This insert 22 would ideally be centrally located within heat pipe 10 and would extend along the wetted length of the working fluid 20 that collects within inclined heat pipe 10 as shown. Insert 22 will also preferably extend to or slightly above the at-rest level 24 of working fluid 20 as indicated.

Figure 2:
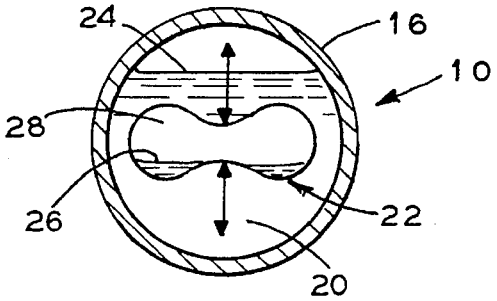
FIG. 2 is a pictorial sectional view taken along lines 2—2 of FIG. 1 and illustrating the location and operation of the invention within the heat pipe.

FIG. 2 illustrates such a central position of insert 22 within heat pipe 10. This figure also indicates that insert 22 is a thin-walled tube, such as a foil pillow, having an hour-glass shape. Insert 22 is also fully sealed on all its sides and ends. Other possible configurations of insert 22 are shown in FIG. 3. Of course, insert 22 can be any shape desired and need not be limited to solely those shapes disclosed herein. The important feature of insert 22 is that it should be constructed of a sealed, thin, impermeable, easily deformed material, such as a metal foil or the like.

No matter what its configuration, insert 22 is filled with a small amount of liquid 26 which is generally the same as working fluid 20. A pressurized inert gas 28 fills the remaining greater volume of insert 22 thereby pressurizing insert 22 to a greater extent than the remainder of heat pipe 10 (i.e. a positive pressure differential exists across insert 22). In other words, the internal pressurization of insert 22 is greater than the external forces acting upon it when working fluid 20 is not frozen. However, when working fluid 20 freezes, such fluid 20 will expand thereby generating freezing pressures greater that the internal pressure of insert 22. Consequently, rather than causing heat pipe 10 to rupture, such freezing/expansion pressures of working fluid 20 are easily accommodated by the compression of insert 22.

One purpose of such a positive pressurization within insert 22 when working fluid 20 is not frozen is so that insert 22 will 'spring back' to its original shape once the freezing pressures acting upon it are no longer present or are reduced. If insert 22 were not so over-pressurized, insert 22 would most likely retain its deformed state after the first freeze cycle and thus would not provide the needed protection (or 'give') required for subsequent freeze cycles.

The cross-section of insert 22 is shaped so as to allow for the flexing of insert 22 under the external freezing pressures exerted upon it during the freezing and expansion of working fluid 20. This shape is configured so as to allow plastic and/or elastic deformation or flexing without failing or rupturing. Consequently, insert 22 will flex and compress during the freezing (i.e. expansion) of working fluid 20 so that outer heat pipe 10 will not be subject to such forces and thus possibly fail. Alternatively, insert 10 will absorb a sufficient amount of the generated freezing pressures such that any remaining pressure will not be sufficient enough to cause damage to outer heat pipe 10. The hour-glass configuration of insert 22 is designed to contract at its 'waist' section so as to accommodate any external ice pressure it might be subject to. Such an hour-glass shape could also result from plastic deformation after the first freeze cycle of an oval shaped insert 22 as shown in FIG. 3*a*.

As stated earlier, insert 22 will only extend within heat pipe 10 within hot end 16 so as to be immersed within working fluid 20. It serves no purpose for insert 22 to extend along the full length of heat pipe 10 since freeze protection is only required where working fluid 20 collects. During any freezing of working fluid 20, the expansion of such working fluid 20 will cause insert 22 to be compressed. This will prevent any build up of any freezing pressures against the walls of heat pipe 10 thereby eliminating any possibility of such heat pipe 10 rupturing due to the freezing of working fluid 20. Instead, such freezing pressures will be accommodated by insert 22. However, once working fluid 20 thaws, the over-pressurization of insert 22 will return insert 22 to it original shape, ready for the next onslaught of freezing pressures.

Figure 3A:
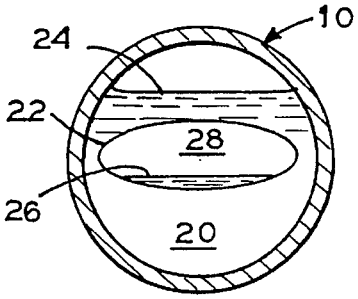
FIG. 3*a–c* are pictorial sectional views similar to that of FIG. 2 but illustrating different embodiments or configurations of the invention.
Figure 3B:
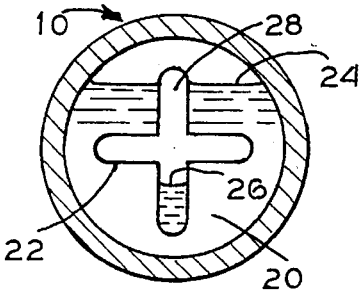
Figure 3C:
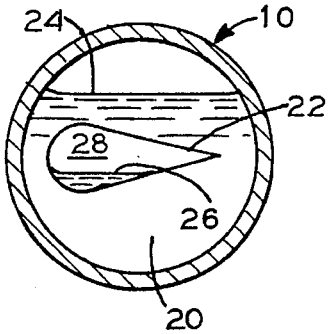

While FIGS. 3*a*–3*c* disclose additional configurations of insert 22 (FIG. 3*a* being an oval, FIG. 3*b* being a cross, and FIG. 3*c* being a tear-drop), other configurations are also likely. The important features of any shaped insert 22 are as follows:

(a) its construction of a sealed, impermeable, flexible, thin-walled material such as a foil pillow or the like, (*b*) its over-pressurization with respect to the pressure of working fluid 20 (i.e. the interior of heat pipe 10) in its non-frozen state, (c) the ability of insert 22 to flex and give when working fluid 20 freezes, yet return to its original shape once the threat of freezing is no longer present, (d) the containment of a small amount of liquid 26 (generally the same as working fluid 20) within insert 22 with the remainder of insert 22 being filled with an inert pressurized gas, and (e) extending insert 22 only within the working fluid 20 region of hot side 16 of the heat pipe 10.

Such insert 22 is retained in its generally central position within heat pipe 10 by the use of straps or supports (not shown) which support insert 22 along its length. Preferably, such straps or inserts will not be continuous but instead will be intermittent or spaced along the length of insert 22 so as not to interfere with the flow or movement of working fluid 20 within heat pipe 10. The actual construction of insert 22 may be thin carbon or stainless steels, but other materials are also likely so long as they are strong and flexible enough to withstand repeated applications of freezing pressures (i.e. repeated deformations) and they do not react with either working fluid 20 or heat pipe 10.

While the above is described with respect to a heat pipe heat exchanger 12, it should be readily understood that insert 22 is equally applicable to any liquid containing pipe or conduit which is subject to freezing and/or rupture if exposed to freezing temperatures.

What is claimed is:

1. An insert for freeze protecting an elongated pipe containing a working fluid therein comprising an elongated, sealed, thin-walled, flexible insert extending within the working fluid of the pipe and containing a liquid/gas mixture therein, said insert having an internal pressure greater than that of the working fluid in its non-frozen state, said insert being compressed upon the freezing of the working fluid thereby accommodating such expansion of the working fluid within the confines of the pipe without over-pressurizing the pipe, said insert expanding in volume when the freezing forces generated by the working fluid recede.

2. The insert as set forth in claim 1 wherein the liquid portion of said liquid/gas mixture within said insert is the same as the working fluid and wherein the gas portion of said liquid/gas mixture within said insert is inert.

3. The insert as set forth in claim 2 wherein said insert is generally centrally located within the pipe and terminates at or slightly above the level of the working fluid in the pipe.

4. The insert as set forth in claim 3 wherein the longitudinal axis of said insert is generally parallel to the longitudinal axis of the pipe.

5. The insert as set forth in claim 4 wherein said longitudinal axis of said insert is co-axial with the longitudinal axis of the pipe.

6. The insert as set forth in claim 4 wherein said insert is constructed of a metal foil.

7. The insert as set forth in claim 4 wherein said working fluid comprises water or is water based.

8. A freeze protected heat pipe comprising:

(a) an elongated, closed heat pipe containing a working fluid therein, said heat pipe being at a first pressure; and, (b) an elongated, closed, thin-walled, flexible insert extending within said working fluid of said heat pipe and containing a liquid and a gas therein, said insert being at a pressure greater than said first pressure, said insert being compressed upon the freezing of the working fluid thereby accommodating such expansion of the working fluid within the confines of the pipe without over-pressurizing the pipe, and wherein said insert generally returns to its original shape upon the thawing of the working fluid.

9. The insert as set forth in claim 8 wherein said liquid within said insert is the same as the working fluid and wherein said gas within said insert is inert.

10. The insert as set forth in claim 9 wherein said insert is generally centrally located within said heat pipe and terminates at or slightly above the level of said working fluid in said heat pipe.

11. The insert as set forth in claim 10 wherein the longitudinal axis of said insert is generally parallel to the longitudinal axis of the pipe.

12. The insert as set forth in claim 11 wherein said longitudinal axis of said insert is co-axial with the longitudinal axis of the pipe.

13. The insert as set forth in claim 11 wherein said insert is constructed of a metal foil.

14. The insert as set forth in claim 11 wherein said working fluid comprises water or is water based.

15. A freeze protected heat pipe heat exchanger comprising:

(a) a plurality of inclined elongated heat pipe extending from a lower hot side of the heat exchanger to an upper cold side thereof, said heat pipe containing a working fluid in said hot side at a first pressure; and (b) an elongated, closed, thin-walled, flexible insert immersed within said working fluid in said hot side of said heat pipe, said insert containing a liquid and a gas therein at a pressure greater than said first pressure, said insert being compressed upon the freezing of the working fluid thereby accommodating such expansion of the working fluid within the confines of the pipe without over-pressurizing the pipe, and wherein said insert generally returns to its original shape upon the thawing of the working fluid.

16. The insert as set forth in claim 15 wherein said liquid within said insert is the same as the working fluid and wherein said gas within said insert is inert.

17. The insert as set forth in claim 16 wherein said insert is generally centrally located within said heat pipe and terminates at or slightly above the level of said working fluid in said inclined heat pipe.

18. The insert as set forth in claim 17 wherein the longitudinal axis of said insert is generally parallel to the longitudinal axis of the pipe.

19. The insert as set forth in claim 18 wherein said longitudinal axis of said insert is co-axial with the longitudinal axis of the pipe.

20. The insert as set forth in claim 18 wherein said insert is constructed of a metal foil.

21. The insert as set forth in claim 18 wherein said working fluid comprises water or is water based.

* * * * *